United States Patent [19]

Fredrikson et al.

[11] 4,441,191

[45] Apr. 3, 1984

[54] APPARATUS FOR HEATING A CONTINUOUS FLOW OF MOLTEN METAL

[75] Inventors: Bengt Fredrikson; Bertil Hans, both of Västerås, Sweden

[73] Assignee: Asea AB, Västerås, Sweden

[21] Appl. No.: 311,442

[22] Filed: Oct. 14, 1981

[30] Foreign Application Priority Data

Nov. 20, 1980 [DE] Fed. Rep. of Germany ..... 8008136

[51] Int. Cl.[3] ..... H05B 5/14

[52] U.S. Cl. ..... 373/161; 373/163; 222/593

[58] Field of Search ..... 373/161, 162, 163, 159; 222/592, 593, 594, 604

[56] References Cited

U.S. PATENT DOCUMENTS

| | | | |
|---|---|---|---|
| 2,568,525 | 9/1951 | Waddington et al. | 222/592 X |
| 3,005,858 | 10/1961 | Lang | 373/159 |
| 3,522,355 | 7/1970 | Brittain | 373/161 |

*Primary Examiner*—Roy N. Envall, Jr.

*Attorney, Agent, or Firm*—Kenyon & Kenyon

[57] ABSTRACT

A horizontally elongated furnace to contain a molten metal flow having one end provided with an inlet and the other with an outlet for the flow. An AC powered channel-type inductor is connected to the furnace side wall at an opening below the level of the metal flow. The inductor may be removably mounted to the furnace.

2 Claims, 2 Drawing Figures

APPARATUS FOR HEATING A CONTINUOUS FLOW OF MOLTEN METAL

This invention is an apparatus for heating a continuous flow of molten metal.

It is useful in connection with the continuous casting of steel for heating the continuous flow of molten steel teemed from the ladle to the continuous casting mold. The ladle can be filled with overheated steel to compensate for cooling occurring during the casting time but this is undesirable for metallurgical reasons. By the use of this invention heat can be put into the steel flow from the ladle to the mold so as to avoid the overheating practice.

Briefly summarized, this new apparatus comprises a horizontally elongated furnace adapted to contain the molten metal flow and having one end provided with an inlet and the other end provided with an outlet for the flow. An AC powered channel-type inductor is connected to the furnace's side wall and the latter has an opening below the level of the flow in the furnace, with which the inductor's channel connects so as to be filled with the metal. Preferably the inductor is removably connected to the furnace side wall so that its channel can be repaired when necessary and in addition can be made from a refractory too expensive for use as a furnace lining. The outlet is in the form of a refractory nozzle and the inductor is positioned so as to decline towards the outlet, so that by shutting down and tilting the furnace away from its outlet end the nozzle can be freed from the melt for repair or replacement while retaining metal in the inductor's channel as required for putting the furnace back in operation. When oppositely tilted the channel and entire furnace can be emptied.

The inductor and side wall opening can be positioned at the middle of the furnace and the furnace side wall that is opposite formed to provide a portion which projects horizontally towards the side wall opening and inductor for directing the flow into the inductor's channel while providing a throttling effect on the flow. This forms a vertical channel on that side wall's exterior which can be covered to form a vertical water-cooling chamber for cooling the inwardly projecting side wall portion. The water temperature then depends on the temperature of the flowing metal and by a temperature sensor for the water the temperature can be detected, permitting casting heat control by adjusting the inductor's power in-put.

Figure 1:
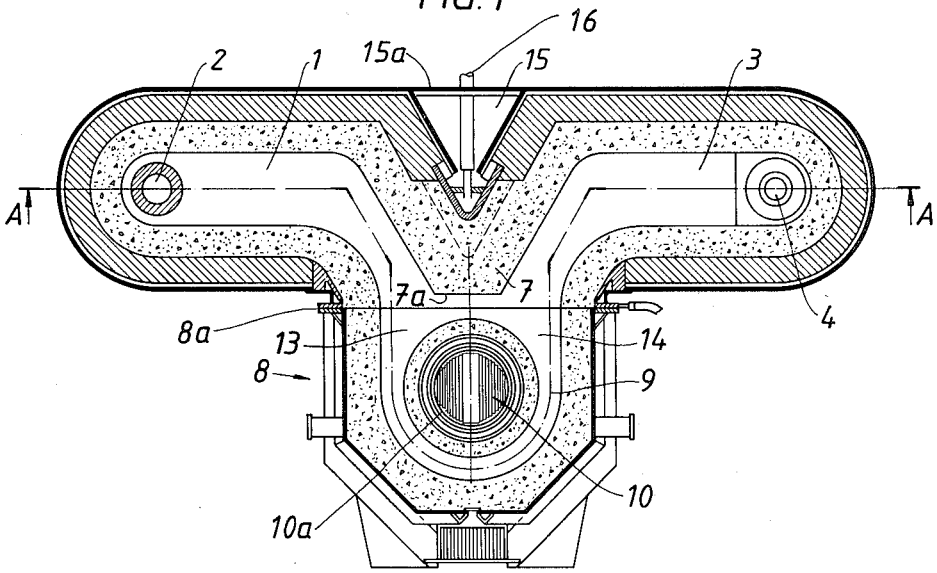
Figure 2:
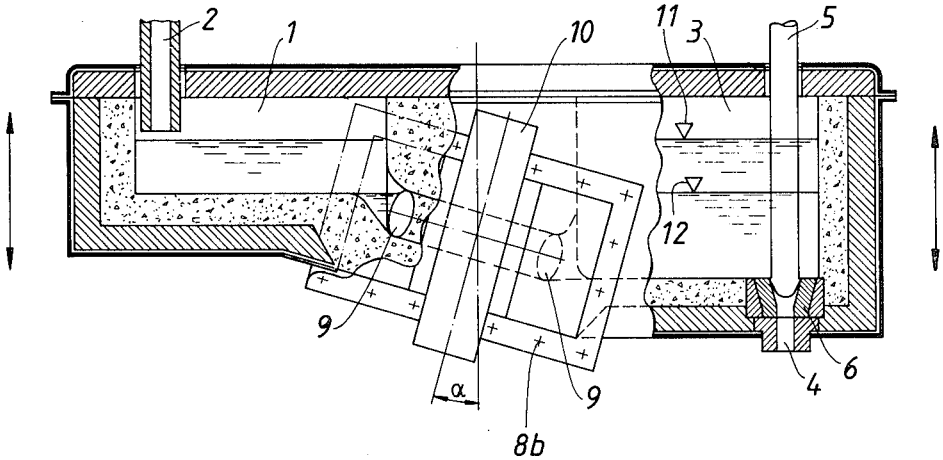

The accompanying drawings are for use in connection with the following detailed description of the invention, FIG. 1 being a horizontal section through the furnace and FIG. 2 a vertical section taken on the line A—A in FIG. 1 but with the inductor and adjacent furnace side wall portion in elevation.

The illustrated horizontally elongated furnace forms an inlet chamber 1 through the top or roof of which a molten metal flow inlet 2 extends, and an outlet chamber 3 having a bottom with an outlet 4 for the flow. Because the furnace can be used in the manner of a tun dish during the continuous casting of steel, a stopper rod 5 is shown cooperating with a refractory nozzle 6 of the outlet, permitting control of the casting rate. The inlet and outlet are at opposite ends of the furnace. At the middle of the furnace one furnace side wall is formed to provide a central side wall portion 7 which inwardly projects horizontally towards the opposite side wall. This opposite side wall is formed with an opening and a channel-type inductor 8 is removably connected to this side wall by means of flanges 8*a* which may be releasably interfastened and sealed with a non-sintering refractory. Releasable screw fasteners 8*b* can be used.

The bottom of the outlet chamber 3 is at a level below that of the inlet chamber 1 and the inductor is positioned so that its channel 9 declines towards the bottom of the chamber 3. At that end the channel opening is flush with the bottom of the chamber 3, the bottom of the chamber 1 being shaped to feed the channel at its other end. The inductor's core is shown at 10 and its coil at 10*a*.

The furnace side walls are straight and mutually parallel and the projection 7 is made by the wall one portion deviating inwardly with a V shape which is symetrically positioned relative to the inductor so as to converge towards the inductor with a flat tip surface 7*a* spaced from the inductor so as to form a flow-throttling and induction heating channel operatively associated with the inductor.

The normal flow level is normally maintained about at 11 and should be high enough in any event to provide the hydrostatic head required to prevent pinch-off in the channel of the inductor. When nozzle repair or replacement is necessary the flow through the furnace is stopped, the melt level is dropped to the level shown at 12 and the furnace is tilted so as to raise its outlet and or lower its inlet end so that the melt flows clear from the nozzle by flooding into the chamber 1. The angularity of the inductor is such that at this time its channel 9 can retain the metal required for restarting operation of the furnace. For illustrative purpose, arrows are shown to indicate that the furnace can be tilted. Opposite tilting can completely empty the furnace.

Preferably the inductor channel 9 is lined with one of the special refractories providing maximum possible resistance to the erosion and temperatures conditions in the channel, and which is too expensive for use as a furnace lining. The furnace lining itself can be of the usual refractory construction.

When used in connection with the continuous casting of steel the steel is teemed through the inlet 2 and flows through the furnace and out the nozzle 6 under the control of the stopper rod 5 so as to maintain the desired casting rate, the feed through the inlet being controlled so as to maintain steel level 11. With the inductor 8 powered, the steel in the inlet chamber 1 flows through the inductor's channel 9 via its openings 13 and 14. The inductor channel opens below the level of the bottom of the chamber 1 and flush with the bottom of the chamber 3. Above the channel the metal flows between the chambers 1 and 3. Between the flat end 7*a* and the side wall projection 7 the inductor's motor force is also provided.

The result of the above is a violent agitation of the metal flow through the furnace, providing uniform heating of the flow and adequate agitation to agglomerated slag entrapped by the flow of molten steel. The agglomerated slag floats to the surface of the flow where it collects for removal after the furnace is shut down because the casting operation is completed.

The projection 7 which is wedge-shaped in cross section directs the lower portion of the metal flow to the openings 13 and 14 of the inductor's channel while at the same time deflecting flow from the chamber 3 back to the chamber 1. This contributes to the agitation of the flowing metal. The restricted space between the projection 7 and the inductor and its side wall, throttles the flow and increases its velocity, further promoting agitation.

To provide the projection 7 the furnace wall extends alternately inwardly and outwardly so as to form an external channel 15 extending for the height of the projection 7. The outside of this channel has a cover 15*a* so that this channel is formed into a closed chamber which can be provided with flowing water for cooling. The temperature of this water flow is a direct reflection of the temperature of the molten metal flow on the inside of the furnace. By the use of a temperature sensing probe 16 it is possible to control the power input to the inductor to keep the temperature of the flow at a desired casting temperature obviating the need for charging the pouring ladle with overheated steel. A uniform casting temperature is made possible.

What is claimed is:

1. An apparatus for heating a continuous flow of molten metal and comprising a horizontally elongated furnace adapted to contain the flow and having opposite ends of which one is provided with an inlet for the flow and the other end is provided with an outlet for the flow, the furnace having a side wall, the side wall having an opening below the level of the flow in the furnace and an inductor having an induction heating channel connecting with the opening, the inductor and side wall opening being positioned substantially at the middle of the furnace and the furnace having a side wall opposite to the one having the opening and which has a central side wall portion which inwardly projects horizontally towards the side wall opening and inductor.

2. The apparatus of claim 1 in which the side wall portion has a substantially wedge-shaped cross section and is symetrically positioned relative to the inductor and opening so as to converge theretowards with a flat tip surface spaced from the inductor so as to form an induction heating channel operatively associated with the inductor.

* * * * *